US005582302A

United States Patent [19]

Kozak

[11] Patent Number: 5,582,302

[45] Date of Patent: Dec. 10, 1996

[54] CONTAINER SUPPORTING PRODUCT DISPLAY RACK

[76] Inventor: Ira M. Kozak, 2475 Woodlawn Dr., Northbrook, Ill. 60062

[21] Appl. No.: 523,740

[22] Filed: Sep. 5, 1995

Related U.S. Application Data

[63] Continuation of Ser. No. 110,310, Aug. 23, 1993, abandoned.

[51] Int. Cl.[6] ..... A47B 73/00

[52] U.S. Cl. ..... 211/74; 211/128; 211/181

[58] Field of Search ..... 211/74, 181, 128, 211/106; D9/526, 560, 517

[56] References Cited

U.S. PATENT DOCUMENTS

| | | | |
|---|---|---|---|
| 16,533 | 2/1886 | Warner | 211/74 X |
| D. 86,017 | 1/1932 | Fuerst | D9/526 |
| D. 110,477 | 7/1938 | Carpenter | D9/526 |
| D. 138,192 | 7/1944 | Ansell | D9/526 |
| D. 234,042 | 1/1975 | Barton | D9/526 |
| 2,145,879 | 2/1939 | Jewett | 211/74 X |
| 2,314,500 | 3/1943 | Jacobson | 211/74 |
| 4,248,352 | 2/1981 | White | 211/106 X |
| 4,726,477 | 2/1988 | Martin | 211/128 |

FOREIGN PATENT DOCUMENTS

| | | | |
|---|---|---|---|
| 386227 | 1/1933 | United Kingdom | 211/74 |

*Primary Examiner*—Blair Johnson

*Attorney, Agent, or Firm*—Marshall, O'Toole, Gerstein, Murray & Borun

[57] ABSTRACT

In order to visibly display products of various types in bulk quantities, while at the same time restricting access to the products to maintain them in a safe and clean condition, a product display rack is provided. The rack includes a frame having a support for a container for products mounted thereon. It also includes structure associated with the frame for mounting the rack on a supporting surface. The rack is formed in such manner as to maintain the container in position on the support. Still additionally, a unique product display rack container is disclosed having a pair of parallel generally polygonal-shaped side walls joined by a continuous perimeter wall having an access-giving opening to define a product-containing enclosure.

12 Claims, 2 Drawing Sheets

CONTAINER SUPPORTING PRODUCT DISPLAY RACK

This is a Rule 62 file wrapper continuation of U.S. application Ser. No. 08/110,310, filed Aug. 23, 1993, now abandoned.

FIELD OF THE INVENTION

The present invention is generally directed to displaying products and, more particularly, a container supporting product display rack having unique features.

BACKGROUND OF THE INVENTION

Generally speaking, it is known that there is a need for devices that are capable of displaying a product for sale. This is true of virtually every product manufactured for sale and, particularly, in the retail environment, there are oftentimes special needs that must be met. In practice, these special needs are usually interrelated in a difficult, if not impossible, manner to successful achieve.

More specifically, the primary requirement for nearly any product display device is to render the product highly visible. It is frequently an additional requirement to be able to display a plurality of different, but related, products in a single product display device and, in some instances, it is important to either restrict direct access to the products by the consumer or, at a minimum, to cover the products to keep them dust and dirt free and not readily accessible for handling by passing consumers. Still additionally, it is generally known that most retail environments suffer from a shortage of space for storage of products for sale.

As a result, those who are in the business of marketing products have faced perplexing problems in maximizing exposure to and availability of their products to the consuming public. The first of these problems centers on having a product display that permits adequate viewing of products in an attractive fashion while, if necessary, restricting access to and/or protecting the products from dust and dirt. Furthermore, and particularly if the display of a product is successful, the product may lend itself to display in bulk fashion which can serve to ensure an adequate inventory of that product.

For this reason, it would be highly advantageous to have what would functionally constitute a container supporting product display rack particularly adapted for the retail market. This would allow not only for advantageously displaying a product or products in an attractive, secure and clean environment but also would provide for bulk display particularly at the point of purchase so that there would always be an adequate inventory available to maintain the display with a suitable quantity of the product. Of course, the container supporting product display rack should also be provided with suitable means for identifying one or more of the products and for placing possible pricing information thereon.

While the problems noted in connection with product display and product storage are not product specific, it is particularly noteworthy that storage, display and sale of screwdriver tips are known to suffer from the noted problems.

The present invention is directed to overcoming one or more of the foregoing problems and achieving one or more of the resulting objects.

SUMMARY OF THE INVENTION

It is a principal object of the present invention to provide a new and improved container supporting product display rack. It is a further object of the present invention to provide such a product display rack that is not only capable of restricting or limiting access to products being displayed but also well suited for permitting the viewing of products therein. It is a still additional object of the present invention to provide a product display rack for bulk display purposes.

Accordingly, the present invention is directed to a product display rack comprising a frame having means mounted thereon for supporting a container for products. It further includes means associated with the frame for mounting the rack on a supporting surface as well as means associated with the supporting means for maintaining the container in a selected position relative thereto. Preferably, the frame, supporting means, mounting means, and position maintaining means are all formed of a suitable thickness of wire.

In the exemplary embodiment, the frame is generally rectangular in shape and is disposed in an upwardly and rearwardly inclined non-vertical plane. It is also advantageous for the supporting means to include upper and lower outwardly projecting wire supports each adapted to receive and hold one or more containers in position thereon. Still additionally, the frame preferably includes means for retaining a product information card in a selected visible position at an upper extreme thereof.

With this understanding, the mounting means preferably includes means for optionally mounting the frame on either a horizontal surface or a vertical surface, e.g., a wall or a countertop, depending upon the requirements of a retail store. More specifically, it advantageously includes a downwardly and rearwardly inclined frame portion disposed at an acute angle to a horizontal supporting surface to define a first supporting leg and further includes an upwardly and rearwardly inclined support portion integral with the upper and lower supports to define a second supporting leg wherein the legs are adapted to cooperate with a countertop. With this arrangement, the frame portion and support portion (or legs) are preferably generally U-shaped and with the support portion being spaced forwardly of but parallel to the upwardly and rearwardly inclined frame.

With the foregoing construction, it will be understood that the product display rack can be mounted on a horizontal surface, or countertop. The mounting means can still further advantageously include means for hanging the frame from a vertical support surface such as peg board or a wall in such manner that the supports are positioned generally horizontal. With the latter structure, it will be understood that the product display rack can be suitably mounted on virtually any vertical surface.

As for other details of the present invention, the upper and lower wire supports each preferably define generally rectangular openings disposed in overlapping but horizontally spaced relation. The rectangular openings each advantageously have a depth dimension less than a maximum depth dimension for the containers and greater than a minimum depth dimension for the containers. With this arrangement, the containers each preferably comprise a pair of parallel generally hexagonal-shaped side walls joined by a continuous perimeter wall defining an enclosure.

In a most highly advantageous embodiment, the continuous perimeter wall is preferably defined by a plurality of generally rectangular-shaped perimeter wall portions. There is then provided an opening in one of the perimeter wall portions of each of the containers to provide access to the container enclosure with the opening preferably being disposed in an upwardly and rearwardly inclined one of the perimeter wall portions. Still additionally, the rectangular openings defined by the wire supports have a width dimension substantially equal to the width dimension of the container or containers therein.

In another respect, the present invention is directed to a unique bulk container for a product display rack. It comprises a pair of parallel generally polygonal-shaped side walls disposed in spaced apart relation together with a continuous perimeter wall joining the side walls to define a container enclosure and comprising a plurality of generally rectangular-shaped perimeter wall portions. With this understanding, an opening is provided in one of the perimeter wall portions to provide access to the container enclosure.

Still other objects, advantages and features of the present invention will become apparent from a consideration of the following specification taken in conjunction with the accompanying drawings.

DETAILED DESCRIPTION OF THE PREFERRED EMBODIMENT

Figure 5:
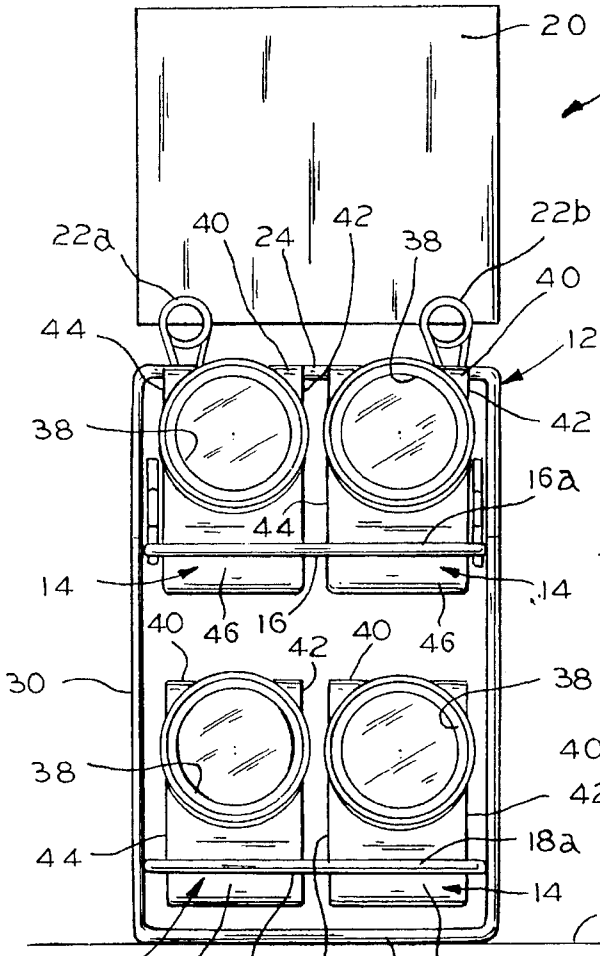
FIG. 5 is a front elevational view showing the product display following insertion of the containers.

In the illustrations given, and with reference first to FIG. 5, the reference numeral 10 designates generally a product display rack in accordance with the present invention. The product display rack 10 includes a frame 12 having means mounted thereon for supporting a container or containers 14 for products and also provided is means associated with the frame 12 for mounting the rack 10 on a supporting surface as will be described in greater detail hereinafter. As will also be described, the product display rack 10 includes means associated with the container supporting means for maintaining the container or containers 14 in a selected position thereon.

Figure 2:
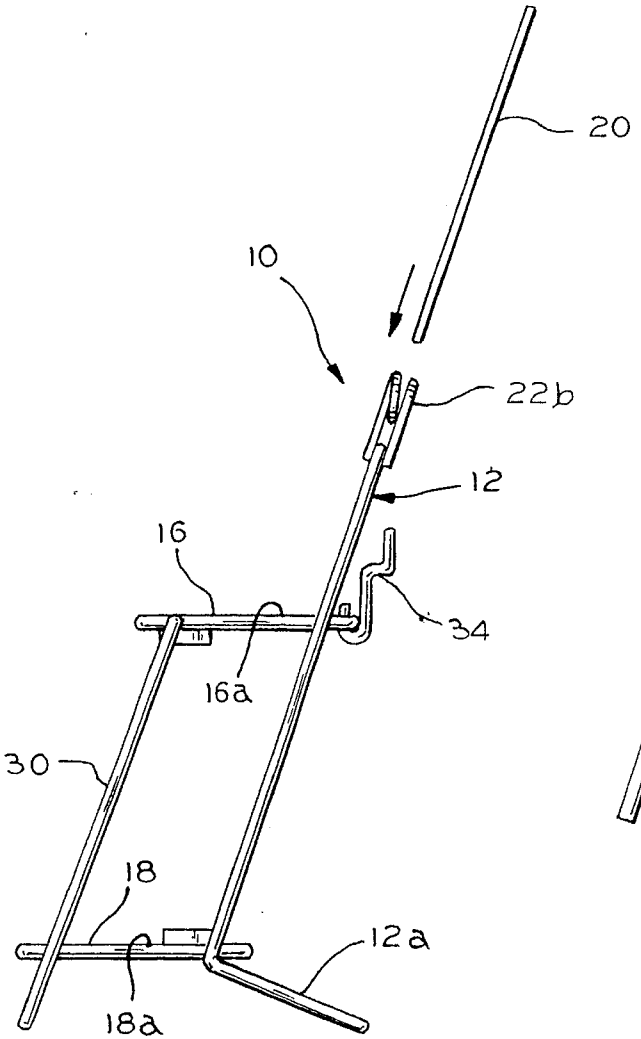
FIG. 2 is a side elevational view of the product display rack as illustrated in FIG. 1.
Figure 1:
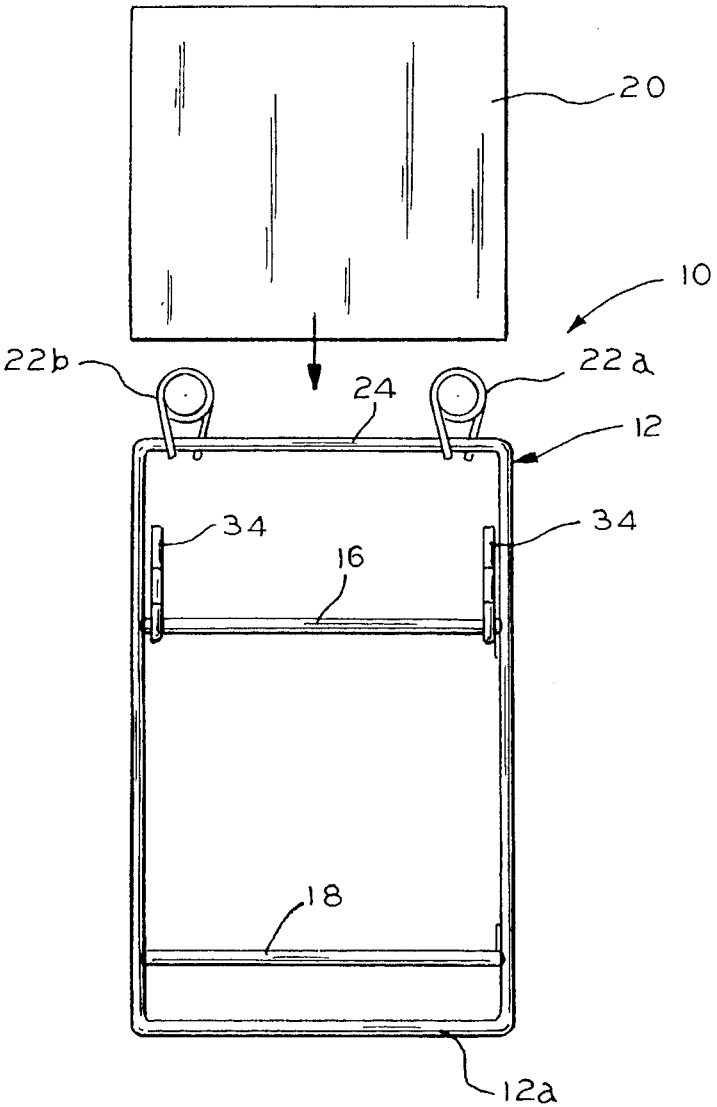
FIG. 1 is a rear elevational view of a product display rack in accordance with the present invention.

Referring to FIGS. 1, 2 and 5, the supporting means will be seen to include upper and lower outwardly projecting supports 16 and 18 each adapted to receive and hold one or more containers 14 for a plurality of products therewithin. It will be seen and appreciated that the upper and lower wire supports 16 and 18 each define a generally rectangular opening **16*a* and 18*a* disposed in overlapping but horizontally spaced or staggered relation such that the openings 16*a* and 18*a* each have a depth dimension (i.e., a dimension along the side shown in FIG. 4) less than a maximum depth dimension for the containers 14 and greater than a minimum depth dimension for the containers 14. Still additionally, and as best shown in FIG. 5, the rectangular openings 16*a* and 18*a* each have a width dimension (i.e., a dimension along the sides shown in FIG. 5) substantially equal to the width dimension of the container or containers 14** therein.

In the preferred embodiment, the product display rack 10 is substantially entirely formed of wire of suitable thickness as will be appreciated from FIGS. 1, 2 and 5. This includes not only the frame 12 and the upper and lower supports 16 and 18 but all of the remainder of the product display rack 10 with the exception of the containers 14 and a product information card 20 that is to be removably retained thereon. In addition, and as best shown in FIG. 1, the frame 12 is preferably, generally rectangular in shape and is disposed in an upwardly and rearwardly inclined non-vertical plane (see, also, FIG. 2).

Figure 3:
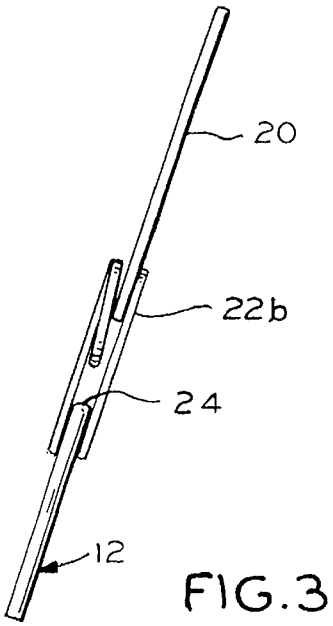
FIG. 3 is an enlarged detail view of a portion of the product display rack of FIG. 2.

As alluded to above, the frame 12 includes means for retaining the product information card 20 in a selected visible position at an upper extreme thereof. This card retaining means comprises in the preferred embodiment at least one, and preferably a pair, of wire retainers **22*a* and 22*b*. As will be appreciated from FIGS. 1 through 3, the wire retainers 22*a* and 22*b* integrally project upwardly from the upper extreme 24 of the wire frame 12**.

Figure 6:
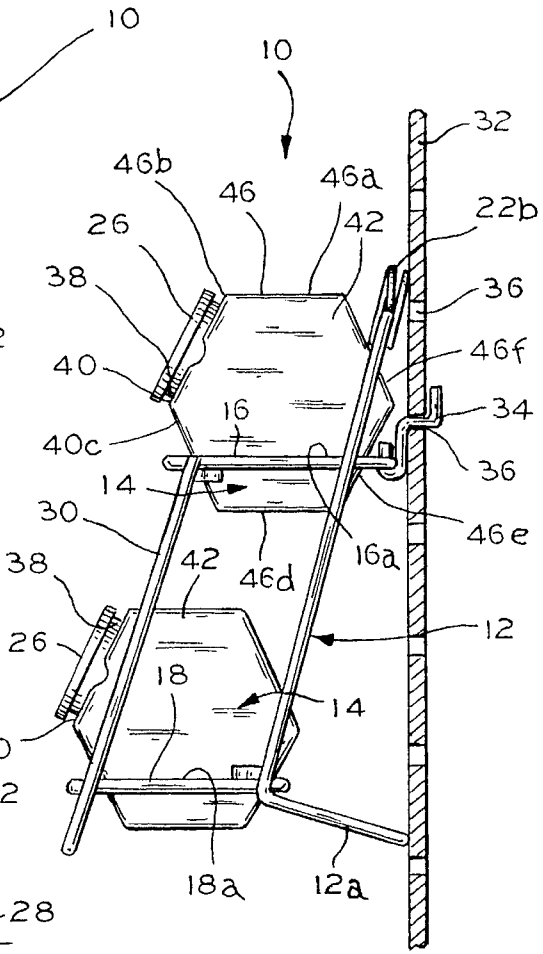
FIG. 6 is a side elevational view of the product display rack hanging from a vertical support surface.
Figure 4:
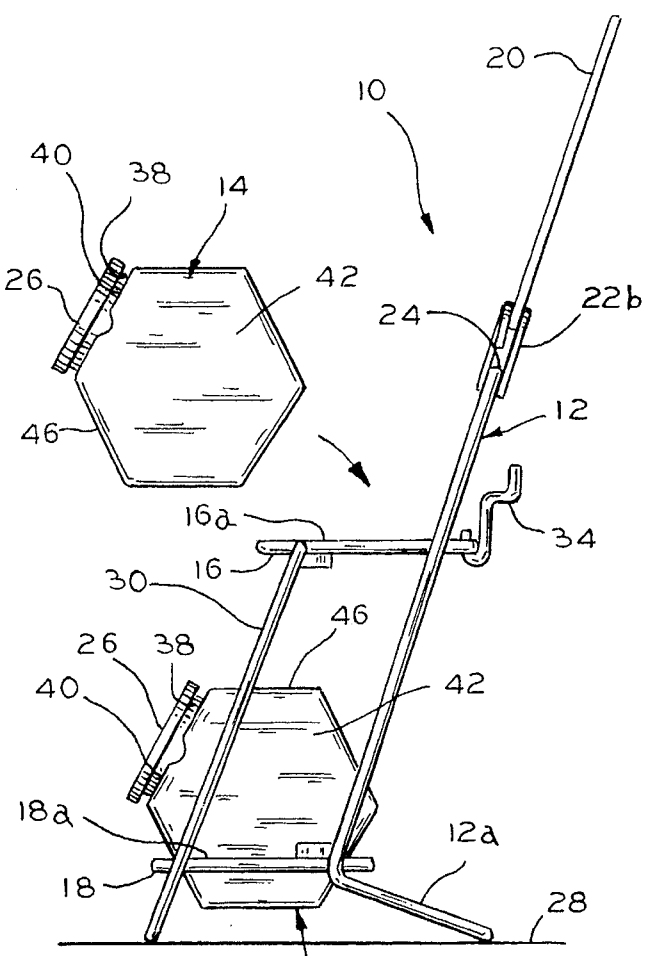
FIG. 4 is a side elevational view of the product display rack showing insertion of containers thereinto.

In the most highly preferred embodiment, the product display rack 10 includes a plurality of containers 14 to be held on the supports 16 and 18 on the wire frame 12. These containers 14 may hold the same, similar, or entirely different products, but they are well suited for holding products in bulk fashion, particularly when they are formed of a transparent plastic material where they may easily be viewed. As shown in FIGS. 4 through 6, the containers 14 may be provided with lids 26 to restrict or limit access of consumers to the products that are contained therewithin.

As previously mentioned, the supports 16 and 18, the mounting means, and the container position maintaining means are all formed of wire integrally associated with the generally rectangular wire frame 12. In this connection, the mounting means preferably includes means for optionally mounting the frame on either a horizontal surface such as a countertop or the like (FIG. 5) or a vertical surface such as a wall, pegboard or the like (FIG. 6) with the former mounting means comprising a downwardly and rearwardly inclined U-shaped frame portion or leg **12*a* disposed at an acute angle to a horizontal supporting surface 28 (FIG. 4) along with an upwardly and rearwardly inclined U-shaped support portion or leg 30 integral with the upper and lower supports 16 and 18. As best seen by comparing FIGS. 4 and 5, the support portion 30 is not only generally U-shaped but also spaced forwardly of but parallel to the upwardly and rearwardly inclined frame 12**.

Referring to FIG. 6, it will be seen and appreciated that the optional mounting means includes means for hanging the frame 12 from a vertical support surface 32. This may include a pair of brackets 34 that are formed about the rear of the upper support 16 and bent into a generally L-shape at the extreme thereof so as to project through and cooperate with holes such as 36 in peg board or the like. When utilized, the brackets 34 cooperate with the downwardly and rearwardly inclined frame portion or leg **12*a* which abuts the peg board 32 to maintain the supports 16 and 18** generally horizontal.

In the illustrated embodiment, the upper and lower outwardly projecting wire supports 16 and 18 each are adapted to receive and hold a pair of containers 14 although the exact number can be varied depending upon the application. However, it will be seen that the upper and lower wire supports 16 and 18 are positioned such that the generally rectangular openings **16*a* and 18*a* and, thus, the corresponding containers 14 supported thereby, are in overlapping but horizontally spaced or staggered relation (FIGS. 4 and 6). As will also be appreciated from FIGS. 4 through 6, the containers 14 are preferably formed such that they each have an opening 38 which may, if desired, be covered by a lid 26 in an upwardly and outwardly facing surface 40** thereof.

With regard to the containers 14, they preferably each comprise a pair of parallel generally polygonal-shaped side walls 42 and 44 disposed in spaced apart relation and a continuous perimeter wall 46 joins the side walls 42 and 44 to define a container enclosure. More particularly, the perimeter wall 46 includes a plurality of generally rectangular-shaped perimeter wall portion 46*a*, 46*b*, 46*c*, 46*d*, 46*e*, and 46*f*. As shown, the container 14 preferably comprises a pair of parallel generally hexagonal-shaped side walls 42 and 44 with the upwardly and outwardly facing surface 40 containing the opening 38 being disposed in the wall portion 46*b*.

As will be appreciated from FIG. 6, the containers 14 are preferably sized such that the wall portion 46*d* will project through the rectangular openings 16*a* and 18*a*. The sizing is such, however, that the front and rear wires of the supports 16 and 18 will make contact with the wall portions 46*c* and 46*e* at an intermediate point substantially as shown to securely hold the containers 14 in a selected position where the lids 26 can be removed from the openings 38 to give limited access to products within the containers 14. In this manner, the products within the containers 14 may be displayed and sold in bulk fashion without any real possibility of spillage or dust and dirt contamination.

While in the foregoing there has been set forth a preferred embodiment of the invention, it will be appreciated that the details herein given may be varied by those skilled in the art without departing from the true spirit and scope of the appended claims.

I claim:

1. A hardware store product display rack, comprising:

an upwardly and rearwardly inclined frame portion having upper and lower vertically spaced and horizontally staggered container support means for supporting containers in a generally vertical orientation, at least one upper container for bulk hardware store products received and supported by said upper container support means and at least one lower container for bulk hardware store products received and supported by said lower container support means such that said upper container is vertically spaced and horizontally staggered to lie in registration with said lower container in a vertically inclined plane with said containers in said generally vertical orientation, and means associated with said inclined frame portion for mounting said rack on at least one of a vertical and horizontal supporting surface with said containers in said generally vertical orientation;

said containers each comprising an enclosure having at least a generally flat bottom wall portion and having an opening remote from said generally flat bottom wall portion for access to said bulk hardware store products, at least said opening in said lower container being formed to lie in a plane generally parallel to said upwardly and rearwardly inclined frame portion when said lower container is supported by said lower support means in said generally vertical orientation with said rack mounted on said supporting surface by said mounting means, said upper and lower support means supporting said upper and lower containers such that said generally flat bottom wall portions of said upper and lower containers are maintained in generally parallel horizontal planes;

said opening in said lower container being horizontally offset to lie forwardly of said upper container and forwardly of said inclined frame portion for access to said bulk hardware store products therewithin.

2. The product display rack of claim 1 wherein said upper and lower containers each comprise a pair of side walls joined by a continuous perimeter wall defining said enclosure, said generally flat bottom wall portions of said upper and lower containers each comprising a portion of said continuous perimeter wall defining said enclosure of the respective one of said containers.

3. The product display rack of claim 1 wherein said inclined frame portion includes means for retaining a product information card in a selected visible position at an upper extreme thereof.

4. The product display rack of claim 3 wherein said card retaining means comprises at least one wire retainer integral with said inclined frame portion and projecting upwardly therefrom.

5. The product display rack of claim 1 wherein said mounting means includes a downwardly and rearwardly inclined frame portion disposed at an acute angle to a horizontal supporting surface.

6. The product display rack of claim 5 wherein said mounting means further includes an upwardly and rearwardly inclined support portion integral with said upper and lower support means.

7. The product display rack of claim 6 wherein said upwardly and rearwardly inclined support portion is generally U-shaped and spaced forwardly of but parallel to said inclined frame portion.

8. The product display rack of claim 1 wherein said mounting means includes means for hanging said rack from a vertical support surface with said containers in said generally vertical orientation.

9. The product display rack of claim 2 wherein said continuous perimeter walls of each of said containers are defined by a plurality of generally rectangular-shaped perimeter wall portions.

10. The product display rack of claim 1 wherein said upper and lower support means of said inclined frame portion project outwardly therefrom, each of said upper and lower support means defining a generally rectangular opening having a depth dimension less than a maximum depth dimension for said containers, said rectangular openings in said support means each having a depth dimension greater than a minimum depth dimension for said containers.

11. The product display rack of claim 1 wherein said upper and lower support means are arranged relative to one another to receive and hold said containers in vertically overlapping relation.

12. The product display rack of claim 1 wherein said inclined frame portion including said container support means is formed of wire and said containers are formed of a transparent plastic material.

* * * * *